US006401888B1

(12) United States Patent
Kuo

(10) Patent No.: US 6,401,888 B1
(45) Date of Patent: Jun. 11, 2002

(54) ROTATABLE AUXILIARY WHEEL SEAT OF A TRUNK

(75) Inventor: Chung-Hsien Kuo, Taipei Hsien (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 22 days.

(21) Appl. No.: 09/609,702

(22) Filed: Jul. 3, 2000

(51) Int. Cl.[7] ..... A45C 5/14
(52) U.S. Cl. ..... 190/18 A; 280/37
(58) Field of Search ..... 190/18 A, 15 R, 190/39, 34; 280/47.315, 47.317, 37, 655, 47.17

(56) References Cited

U.S. PATENT DOCUMENTS 5,873,439 A * 2/1999 Liang ..... 190/18 A
6,182,981 B1 * 2/2001 Kuo ..... 280/37
6,279,705 B1 * 8/2001 Wu ..... 190/18 A

* cited by examiner

*Primary Examiner*—Lee Young
*Assistant Examiner*—Lien Ngo
(74) *Attorney, Agent, or Firm*—Rosenberg, Klein & Lee

(57) ABSTRACT

A carrying case apparatus is provided. The carrying case apparatus includes a trunk body having a pair of corner wheels; a telescopic rod assembly coupled to the trunk body; and, a collapsible auxiliary wheel seat assembly also coupled to the trunk body. The telescopic rod assembly is formed with a handle and a pair of telescopic rods extending substantially in parallel therefrom, as well as linked first and second controllers for selectively locking the telescopic rods in their extended configurations and selectively locking the auxiliary wheel seat assembly in its collapsed position. The auxiliary wheel seat assembly includes an elongate member having a first end pivotally coupled to the trunk body and a second end having an auxiliary wheel coupled thereto which in its opened position serves as a stabilizing support for the trunk body.

10 Claims, 5 Drawing Sheets

ROTATABLE AUXILIARY WHEEL SEAT OF A TRUNK

FIELD OF THE INVENTION

The present invention relates to an rotatable auxiliary wheel seat of a trunk, and especially to an auxiliary wheel installed at the rear side of a trunk, as necessary, the auxiliary wheel can be ejected automatically to support the trunk obliquely and serves to assist the original corner wheels for being pulled, as unnecessary, it can be retracted for storage. In that, a special structure is designed, therefore, the original telescopic rod means serves to control the auxiliary wheel to be ejected out automatically. As a consequent, the operation becomes more conveniently.

BACKGROUND OF THE INVENTION

The prior art trunk, other than a trunk body for receiving articles, includes at least two corner wheels at the bottom of the trunk body, and a telescopic rod means at the back side of the trunk body and is formed by a handle and two telescopic rods. Thereby, the user may pull the telescopic rods and then move the trunk by rolling of the two corner wheels. However, when the user holds the handle and then pulls the trunk obliquely, since the gravitation line of the trunk is shifted from the bottom of the trunk to be tilt, the user must control the tilt angle by the holding force and the feeling of the hand. During the pulling process, the gravitation center of the trunk is changed at all times, therefore, the user must adjust the holding force and direction continuously. Thus, this is not comfort in operation and use. Therefore, an auxiliary wheel seat is designed to be added to a trunk for improving the defect in the prior art.

In the prior art commercial auxiliary wheel, a pair supporting frames having a cambered sliding groove are installed at the lateral side of the back portion of the trunk, and a screwing portion is installed therein. A movable seat with sliding wheel is further pivotally installed on each supporting frame. The movable seat is driven by a driving piece at the supporting frame and a linkage on the sliding groove so as to be rotated in or out with respect to the supporting frame. A buckle with a spring and a hook are installed in the two movable seats so that as the movable seats are pushed into the supporting frame, the hook will buckle the buckling hole of the screwing portion and is hidden therein for being positioned. However, once the lower protruded portion of the hook is pushed, then it will be released so that the movable seat is rotated out. Therefore, the sliding wheel and two corner wheels are formed as a three supporting points and thus the trunk is supported steadily and the user may pull the trunk easily and comfortably.

However, in the trunk with an auxiliary wheel, since the auxiliary wheel is independently installed in a space preset in the back side of the trunk without any connection to the telescopic rod means, therefore, the operation of rotating out or in is independently and manually operated. When the user is desired to pull the trunk, the telescopic rod must be pulled out for being held and then the movable seat must be pushed, thus two steps are necessary to be performed. The operation is tedious and inconveniently. Furthermore, since the auxiliary wheel is independent from the telescopic rod means, and thus, many parts are necessary, which at least includes two supporting frames, two movable seats, a sliding wheel, a screwing portion, a cover, two driving pieces, four linkages, a cover, a buckle, a twisting spring, and a plurality of axial pins, screws and other complex structure. Not only the cost of the parts is high, but also the assembly work is complex and not economical.

SUMMARY OF THE INVENTION

Accordingly, the primary object of the present invention is to provide a rotatable auxiliary wheel seat of a trunk. Thereby, by using the telescopic rod means directly, the user is only necessary to further pull the telescopic rods after it is pulled out, then the auxiliary wheel seat will be ejected out for supporting obliquely. If a tread board is treaded, then it will retract. Not only the operation is conveniently, but also the structure is simple and can be assembled easily.

In order to achieve the aforesaid object, in the present invention, a second controller is installed, which is interacted with the first controller. When the second controller is latched, it is driven by an elastic element and is pivotally installed on the auxiliary wheel seat at the rear side of a trunk. When the telescopic rod is pulled to a first preset position, it can be held by the user to be pulled. It is only necessary to further pull the telescopic rod to a second preset position, the second controller can be acted so that the auxiliary wheel is released so as to be ejected out for supporting obliquely. Thus, the above object is achieved.

The various objects and advantages of the present invention will be more readily understood from the following detailed description when reading in conjunction with the appended drawing.

DETAILED DESCRIPTION OF THE PREFERRED EMBODIMENTS

Figure 2:
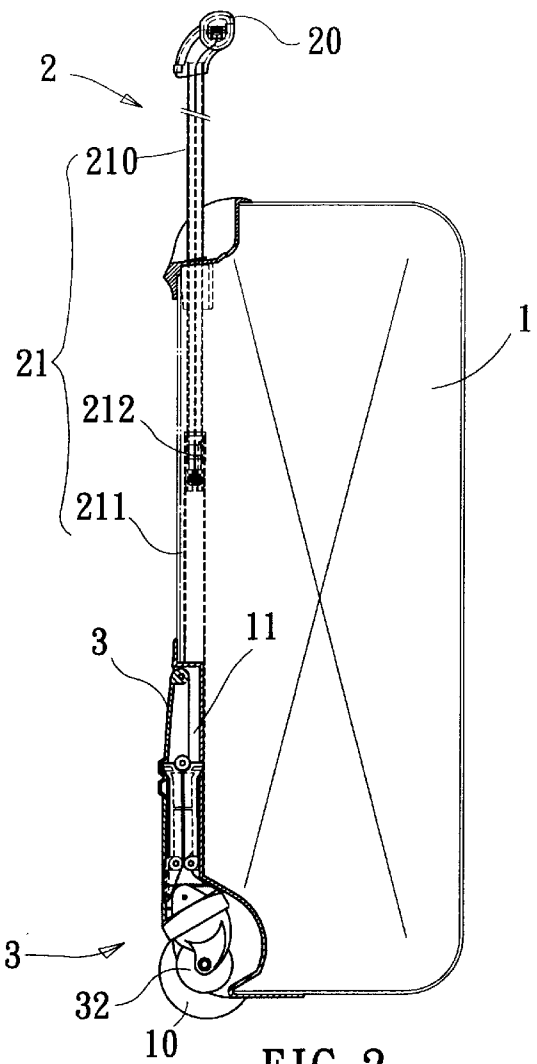
FIG. 2 is a lateral view of FIG. 2.
Figure 1:
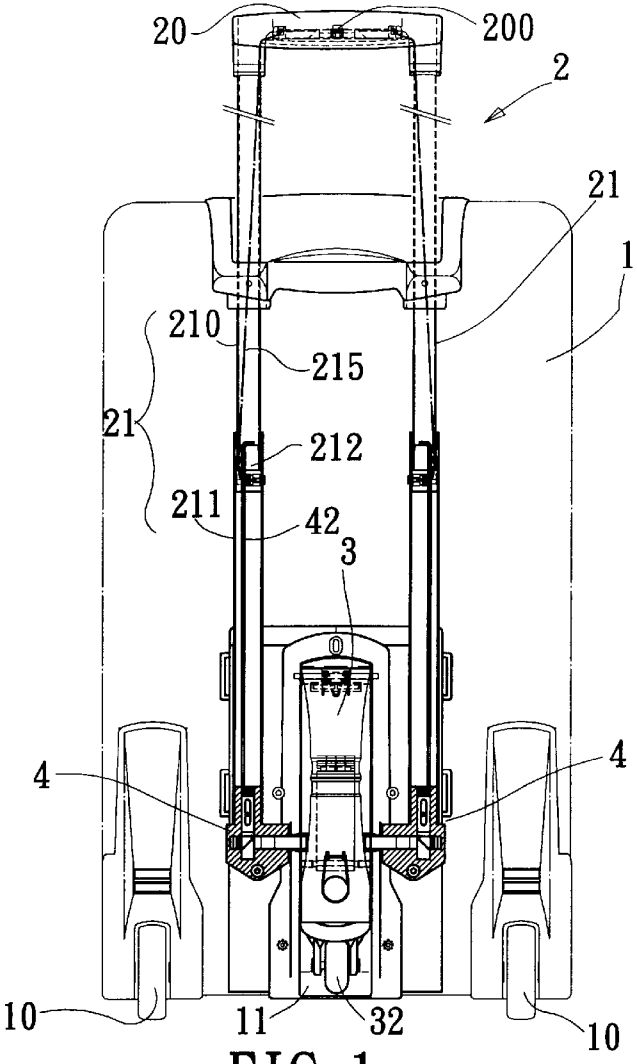
FIG. 1 is a partial schematic cross sectional view showing the structure of the rear side of a trunk.
Figure 3:
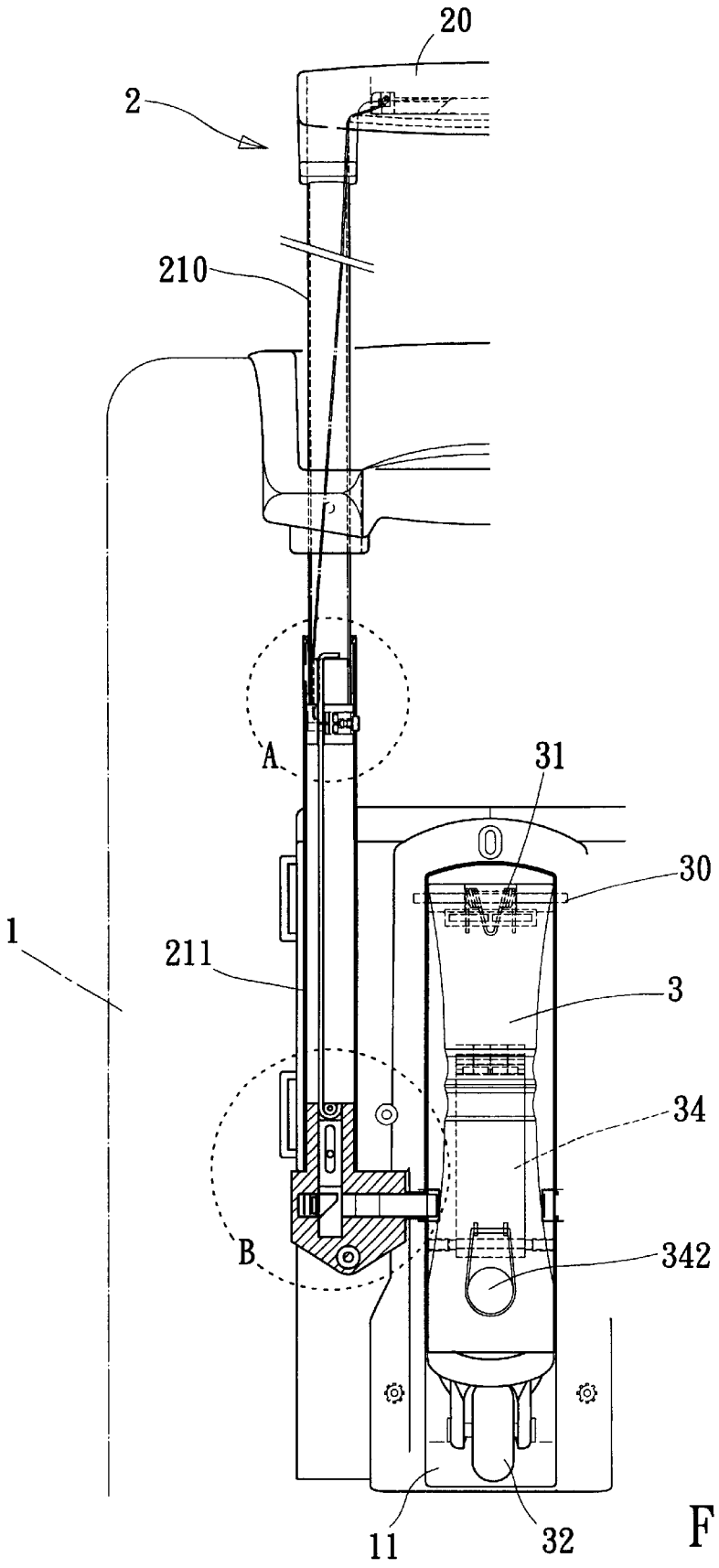
FIG. 3 is a partial perspective view showing the telescopic rod means and auxiliary wheel seat of the present invention being latched.

With reference to FIGS. 1 to 3, the trunk of the present invention is illustrated therein. The trunk according to the present invention includes a trunk body 1, telescopic rod means 2 and an auxiliary wheel seat 3.

The bottom of the trunk body 1 is installed with at least two corner wheels 10, while the center of the back thereof is installed with a receiving groove 11.

Figure 4:
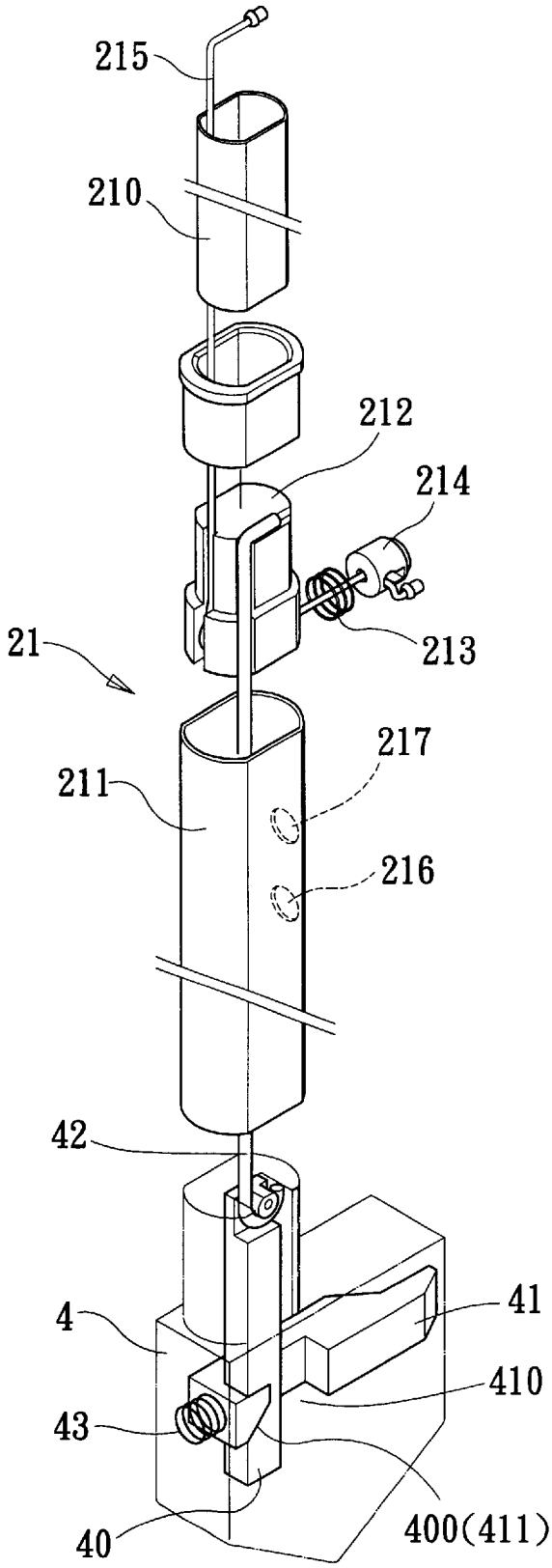
FIG. 4 is a perspective view showing the relation between the telescopic rod means and the auxiliary wheel.

The telescopic rod means 2 is installed at the two sides of the receiving groove 11 in the trunk body 1. The telescopic rod means 2 includes an inverted U-shaped handle 20 and two parallel telescopic rods 21. Each telescopic rod 21 is formed by a plurality of tubes. In this embodiment, it includes a first tube 210 and a second tube 211. Referring to FIG. 4, the bottom of the first tube 210 is installed with a first controller 212, in which a buckle 214 is installed therein, and the buckle 214 can be ejected by a first elastic element 213 to be moved transversally. The buckle is connected to a control switch 200 of the handle 20 by a first connecting means 215, such as steep rope. A positioning hole 216 is formed near the top of the second tube 211, appropriately positioned with respect to the buckle 214 so that as the first tube 210 is pulled upwards, the buckle 214 will engage the positioning hole 216, so as to retained in a locked pulling position with respect to the second tube 211. Then, the user may hold the handle 20 to pull the trunk conveniently. As the user again pushes the control switch 200 of the handle 20, the first linkage 215 will pull the buckle 214 to be retracted from the positioning hole 216 to release the buckling. Then, a force can be applied to push the first tube 210 into the second tube 211 directly. While in the aforesaid embodiment, only the handle 20 serves to control the operable telescopic rod 21 by the switch 200, the first linkage 215 and the first controller 212 may be accordingly moved by other suitable means in other embodiments having the same functions, all without departing from the scope and spirit of the present invention.

A second controller 4 is installed at the bottom of each telescopic rod 21 in the trunk body 1 adjacent to the receiving groove 11. The second controller 4 includes a longitudinal guide rod 40 and a transversal latch 41. The longitudinal guide rod 40 is formed by a second linkage 42, such as an L shaped steel strip, to be hooked in the first controller 212 so that it can be pulled upwards as the first controller is lifted. One side thereof is installed with an inclined groove surface 400. The transversal latch 41 is installed with a sliding groove 410 which receives the longitudinal guide rod 40 in a transversally displaceable manner. At the side of the sliding groove adjacent to the inclined groove surface 400 is formed an inclined protrusion 411. Thereby, as the inclined groove surface 400 and the inclined protrusion 41 are engaged, the transversal latch 41 can be ejected and pushed to be inserted into the receiving groove 11, as shown in FIGS. 1, 3 and 3B. When the longitudinal guide rod 40 is pulled upwards, the transversal latch 41 is responsively retracted, as shown in FIG. 3D.

In the auxiliary wheel seat 3, as shown in FIGS. 1 to 3, a top pivotal shaft 30 is pivotally installed at the tope of the receiving groove 11 and is driven by the third elastic element 31 (for example, a twisted spring) to be in a state to be ejected out. The buckle of the auxiliary wheel seat 3 is installed with one or two auxiliary wheels 32, while two sides thereof are formed with latch holes 33 for being buckled by the transversal latch 41.

Figure 3A:
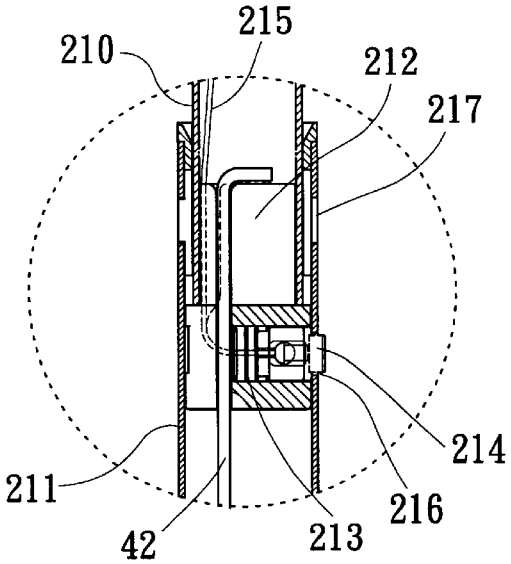
FIG. 3A is a partial enlarged view of the part A in FIG. 3.
Figure 3C:
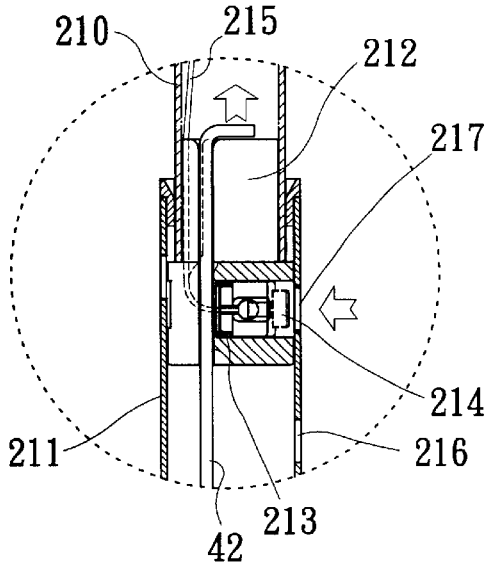
FIG. 3C is an enlarged view showing in the part A of FIG. 3, the telescopic rod means and auxiliary wheel are unbuckled.
Figure 3B:
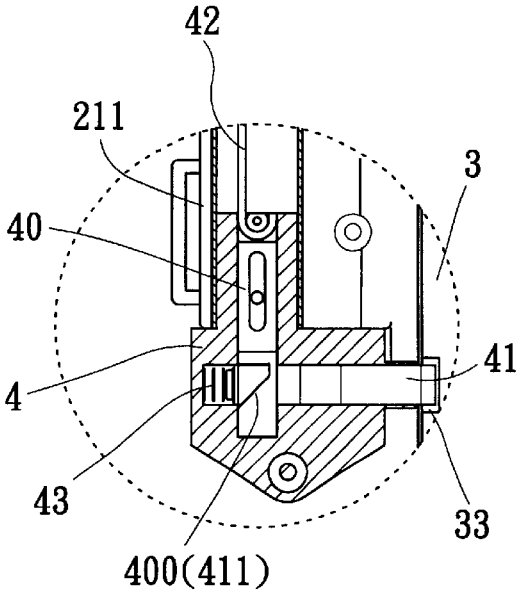
FIG. 3B is a partial enlarged view of the part B in FIG. 3.
Figure 3D:
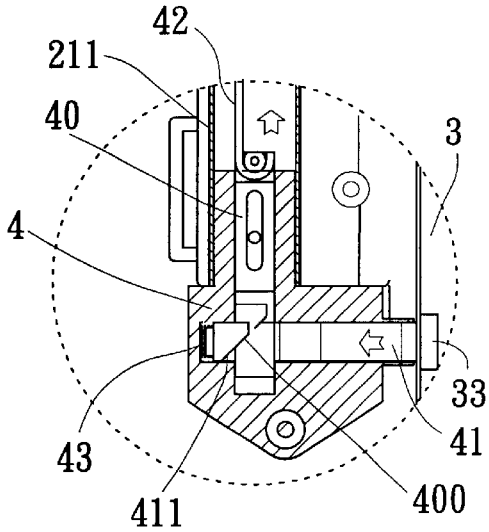
FIG. 3D is an enlarged view showing in the part B of FIG. 3, the telescopic rod means and auxiliary wheel are unbuckled.
Figure 5:
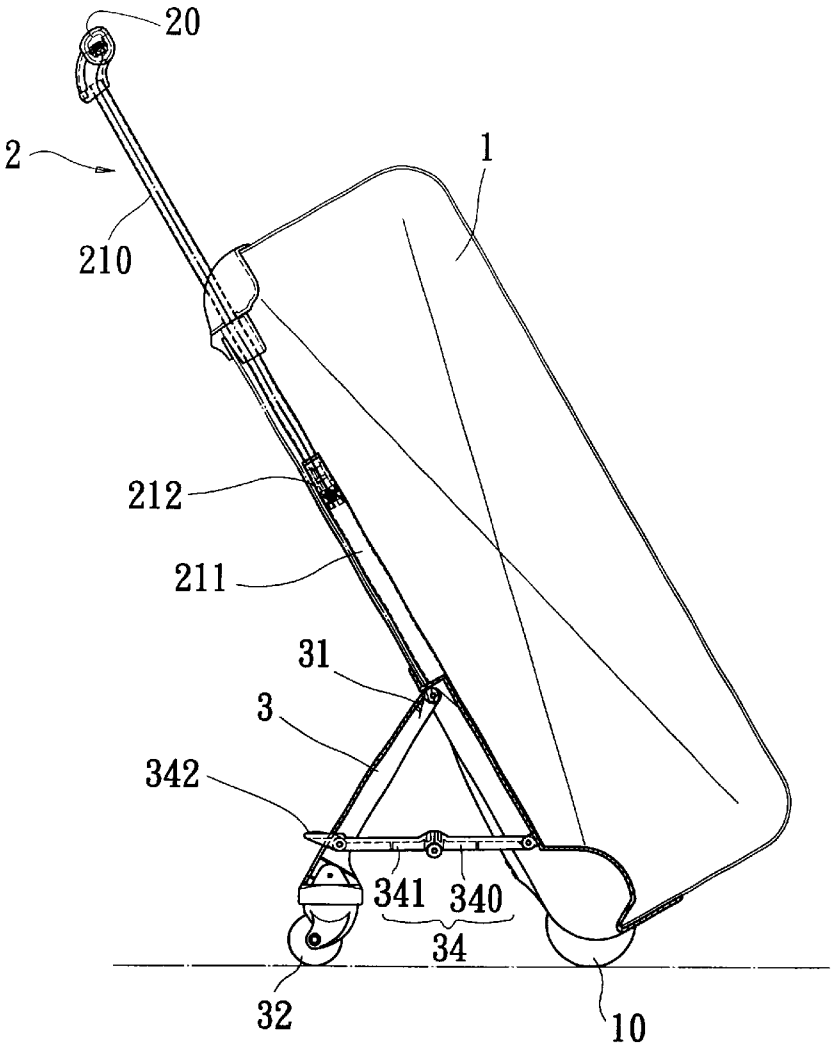
FIG. 5 is a lateral view showing the auxiliary wheel seat is ejected out so that the trunk can be pulled conveniently.

Therefore, when the user desires to use the trunk, the user may hold the handle 20 and squeeze the control switch 200 so as to pull the telescopic rod 21 directly until the buckle 214 of the first controller 212 is buckled into the positioning hole 216 to be positioned as shown in FIG. 3A. The telescopic rod 21 is then retained in a locked configuration to be pulled. Moreover, the user may further squeeze the control switch 200 on the handle 20 so that after the buckle 214 is retracted from the positioning hole 216, the handle 20 is pulled upwards slightly, sch that the buckle 214 slides on the wall of the tube to be positioned thereon, as shown in FIG. 3C. Then, the second linkage 42 will pull the longitudinal guide rod 40 to force the transversal latch 41 to retract backwards from the latch hole 33 of the auxiliary wheel seat 3, as shown in FIG. 3D. If desired, the control switch 200 may be pulled sufficiently higher to cause the buckle 214 to engage a second positioning pole 217 and thereby lock the telescopic rod 21 in its fully extended configuration. Otherwise, under the action of the third elastic element 31, the auxiliary wheel seat 3 will eject out automatically to a set angle, as shown in FIG. 5, for obliquely supporting the trunk body 1. The auxiliary wheel 32 serves cooperatively with the original two corner wheels 10 to support and roll together. Then, it is only necessary to release the control switch 200, as the elastic force of the second elastic element 43 will push the transversal latch 41. The longitudinal guide rod 40 will be pulled and then restored so that the buckle 214 of the first controller 212 descends again to be buckled automatically in the positioning hole 216. Therefore, the operation of the present invention is convenient.

Figure 6:
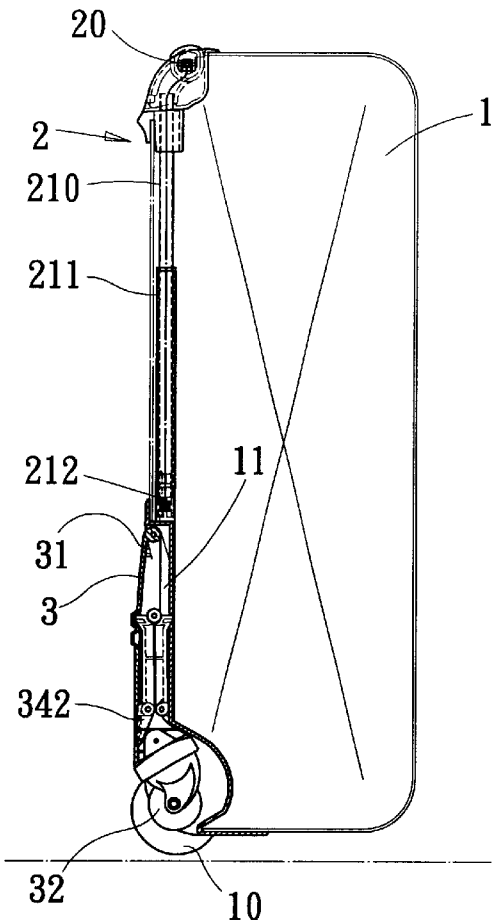
FIG. 6 is a lateral view showing that the auxiliary wheel is received in the receiving groove.

In order that the auxiliary wheel seat 3 can be restored conveniently, in fact, the auxiliary wheel seat 3 and trunk body 1 can be further pivotally installed with a movable crank 34. The movable crank 34 is formed by two pivotally connected supporting arms 340 and 341. The outer supporting arm 341 has an outer end extending outwards with a tread board 342 out of the auxiliary wheel seat 3 so that the user may beneficially tread the tread board by a leg. Thus, the movable crank 34 bends so that the auxiliary wheel seat 3 will retract to the receiving groove 11, as shown in FIG. 6 until the transversal latch 41 of the second controller 4 at two sides are latched in the long holes 33, as shown in FIG. 1 and 3.

In summary, in the present invention, the auxiliary wheel seat of a trunk of the present invention directly modifies a telescopic rod means 2. Therefore, the user may only pull the telescopic rod 21 upwards through a distance for being pulled, or being pulled upwards so that the auxiliary wheel seat 3 to be ejected out for being used, or the control switch 200 can be pressed continuously to be pulled upwards through two operational stages so as to perform the pulling of the telescopic rod 21 and the ejection of the auxiliary wheel 3. Not only the operation is very easy and the structure is simple so as to be assembled easily and simply.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A carrying case apparatus comprising:

(a) a trunk body having a pair of corner wheels disposed at a bottom portion thereof, said trunk body having formed at an intermediate portion thereof a receiving groove;

(b) a telescopic rod assembly coupled to said trunk body, said telescopic rod assembly including:

(1) a handle having a control switch for actuation by a user;

(2) a pair of telescopic rods extending in substantially parallel manner from said handle, each said telescopic rod having telescopically coupled first and second tubes, said second tube having at least one positioning hole formed adjacent a top end portion thereof;

(3) a pair of first controllers coupled to said control switch by a first linkage for selectively locking each said first tube to a respective one of said tubes of said telescopic rods, each said first controller being coupled to a bottom end portion of a respective one of said first tube, each said first controller being resiliently biased for engagement of said positioning hole of a respective one of said second tubes; and, (4) a pair of second controllers each operably coupled to one of said first controllers by a second linkage, each said second controller being disposed adjacent a bottom end portion of a respective one of said second tubes, each said second controller having a longitudinal guide rod and a transversal latch slidably engaged one with the other, each said transversal latch being transversally displaceable between extended and retracted positions responsive to longitudinal displacement of one of said longitudinal guide rods, said transversal latch in said extended position extending into said receiving groove of said trunk body; and, (c) a collapsible auxiliary wheel seat assembly coupled to said trunk body, said auxiliary wheel seat assembly including:

(1) an elongate member having first and second end portions of an intermediate portion extending therebetween, said first end portion being pivotally coupled to said trunk body, said intermediate portion having formed therein a pair of latch hole recesses; and, (2) an auxiliary wheel coupled to said second end portion of said elongate member;

said auxiliary wheel seat assembly being configurable between collapsed and opened positions, said auxiliary wheel seat assembly in said collapsed position being received in said receiving groove of said trunk body, said auxiliary wheel seat assembly being locked in said collapsed position by said transversal latches of said second controllers respectively engaging said latch hole recesses thereof.

2. The carrying case apparatus as recited in claim 1 wherein said transversal latch of each said second controller is resiliently biased toward said extended position.

3. The carrying case apparatus as recited in claim 2 wherein each said transversal latch of each said second controller has formed therein a sliding groove for receiving at least a portion of said longitudinal guide rod, each said transversal latch having formed thereon an inclined protrusion, each said longitudinal guide rod having formed thereon an inclined groove surface slidably engaging said inclined protrusion of said transversal latch.

4. The carrying case apparatus as recited in claim 1 wherein each said first controller includes a buckle and an elastic member coupled thereto, said elastic member resiliently biasing said buckle to engage said positioning hole of one of said second tubes.

5. The carrying case apparatus as recited in claim 1 wherein said auxiliary wheel seat assembly includes an elastic member coupled to said elongate member for biasing said elongate member to displace pivotally outward from said trunk body.

6. The carrying case apparatus as recited in claim 5 wherein said elastic member of said auxiliary wheel seat assembly includes a twisted spring coaxially coupled to a pivotal shaft defined at said first end portion of said elongate member.

7. The carrying case apparatus as recited in claim 1 wherein said auxiliary wheel seat assembly includes a movable crank transversally extending in collapsible manner between said intermediate portion of said elongate member and said trunk body.

8. The carrying case apparatus as recited in claim 7 wherein said movable crank includes pivotally jointed outer and inner supporting arms, said outer supporting arm having a terminal end portion defining an outwardly directed tread board surface.

9. The carry case apparatus as recited in claim 1 wherein said first linkage includes a steel rope member.

10. The carrying case apparatus as recited in claim 1 wherein said second linkage includes a substantially rigid steels trip member.

* * * * *